US011705623B2

(12) United States Patent
Sczesny et al.

(10) Patent No.: US 11,705,623 B2
(45) Date of Patent: Jul. 18, 2023

(54) ROOF ANTENNA

(71) Applicant: FUBA Automotive Electronics GmbH, Bad Salzdetfurth (DE)

(72) Inventors: Jürgen Sczesny, Giesen (DE); Matthias Engel, Seesen (DE)

(73) Assignee: FUBA Automotive Electronics GmbH, Bad Salzdetfurth (DE)

( * ) Notice: Subject to any disclaimer, the term of this patent is extended or adjusted under 35 U.S.C. 154(b) by 0 days.

(21) Appl. No.: 17/365,029

(22) Filed: Jul. 1, 2021

(65) Prior Publication Data

US 2022/0013886 A1 Jan. 13, 2022

(30) Foreign Application Priority Data

Jul. 2, 2020 (DE) ..... 102020117525.6

(51) Int. Cl.
*H01Q 1/32* (2006.01)
*H01Q 1/12* (2006.01)
*H01Q 1/42* (2006.01)

(52) U.S. Cl.
CPC ..... *H01Q 1/3275* (2013.01); *H01Q 1/1207* (2013.01); *H01Q 1/1214* (2013.01); *H01Q 1/42* (2013.01)

(58) Field of Classification Search
CPC ..... H01Q 1/1207; H01Q 1/1214; H01Q 1/42; H01Q 1/3275; H05K 5/0013; H05K 5/03; H05K 5/0221; H05K 5/0208
See application file for complete search history.

(56) References Cited

U.S. PATENT DOCUMENTS

| | | | |
|---|---|---|---|
| 7,358,910 B2 | 4/2008 | Blickle | |
| 10,164,314 B2 | 12/2018 | Butscher et al. | |
| 2007/0120755 A1 | 5/2007 | Blickle | |
| 2010/0231467 A1 | 9/2010 | Schnuerer | |
| 2017/0104264 A1 | 4/2017 | Kobayashi | |
| 2018/0034142 A1* | 2/2018 | Nishikawa | H01Q 1/1214 |
| 2019/0280386 A1 | 9/2019 | Kowaita et al. | |

FOREIGN PATENT DOCUMENTS

| | | |
|---|---|---|
| DE | 102009012641 A1 | 9/2010 |
| DE | 102016123369 A1 | 6/2017 |
| DE | 102014018428 B4 | 10/2018 |
| EP | 1777777 A1 | 10/2006 |
| EP | 1777779 A1 | 4/2007 |
| EP | 1760826 B1 | 10/2009 |
| EP | 3561952 A1 | 10/2019 |

OTHER PUBLICATIONS

German Search Report dated Jan. 11, 2021 for German Application No. 102020117525.6, 6 pages.
Anonymous: "Sukudon Auto Demontage Werkzeuge 13-TLG Auto Zierleistenkeile Set für Tür Panel Armaturenbrett Öffner Automotive Reparatur Entfernung Werkzeug Audio Radio CD Lautsprecher".
Search Report from European Patent Office for related EP Application No. 21180674.0; dated Nov. 16, 2021; 4 pages.

* cited by examiner

*Primary Examiner* — Robert Karacsony
(74) *Attorney, Agent, or Firm* — Dickinson Wright PLLC

(57) ABSTRACT

A roof antenna for a vehicle has a cover that is connected to a baseplate via a latching unit. The latching unit comprises latching hooks that releasably engage behind elastic latching lugs.

10 Claims, 2 Drawing Sheets

ROOF ANTENNA

Figure 1:
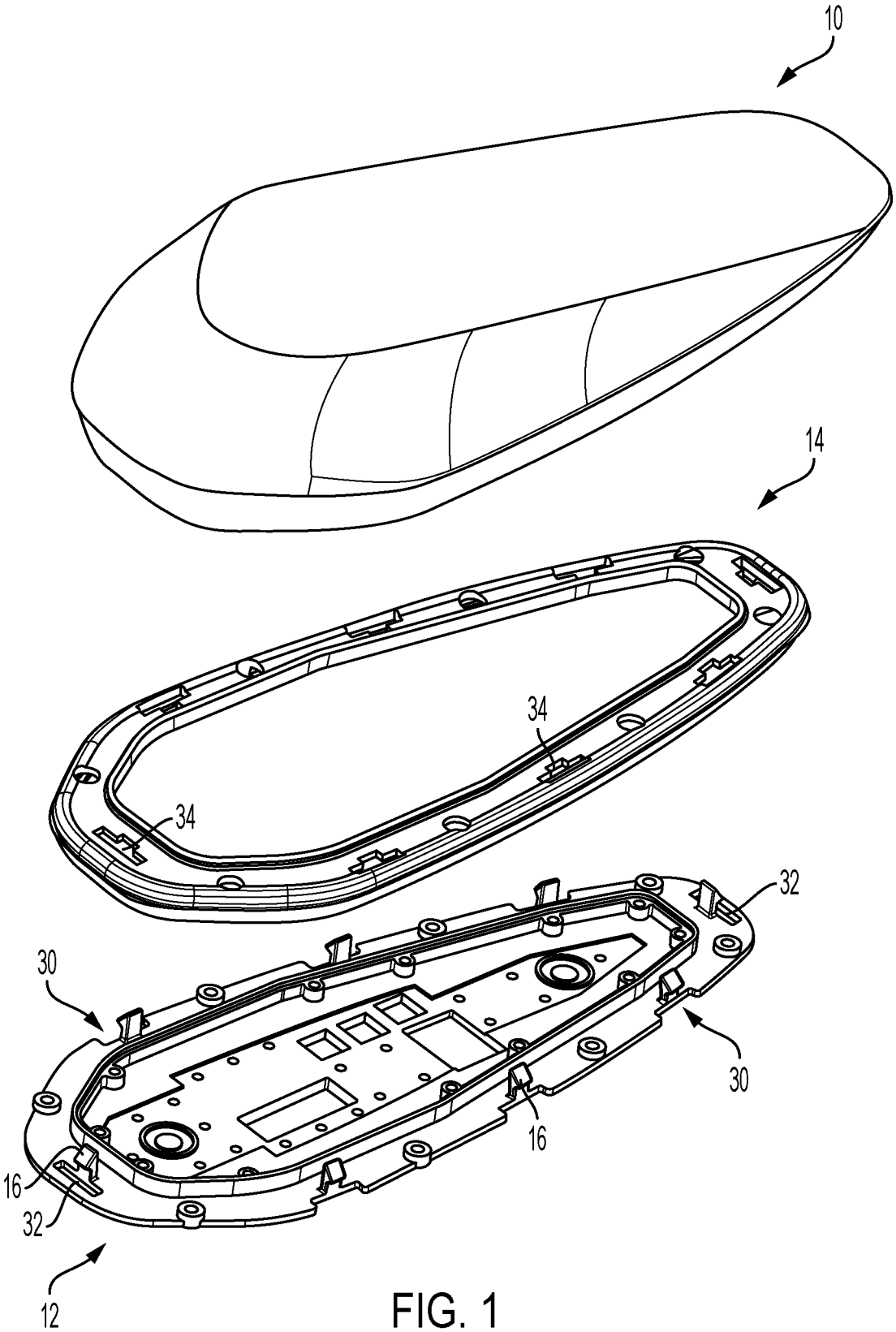

The present invention relates to a roof antenna for a vehicle. Such roof antennas are, by way of example, known in the field of motor vehicle technology in a large variety and are typically fastened at an opening in the vehicle roof. Individual antenna elements, electronic components or GPS receivers are accommodated beneath a cover in a protected manner.

It is the object of the present invention to make available a roof antenna for a vehicle that can be produced in a particularly cost-effective manner, that can be mounted in a simple way and that can be easily demounted in a non-destructive manner.

The solution of this object is made available by the features of claim 1 and in particular by a roof antenna having a cover that is connected to a baseplate via a latching unit that comprises a plurality of latching hooks that engage behind elastic latching lugs. Furthermore, recesses are provided in the baseplate in the region of the latching unit that enable an engagement of a tool for releasing the engagement. Antenna elements can be fastened to the baseplate.

The roof antenna in accordance with the invention can be produced in a very cost-effective manner and can be mounted in a simple way in that the cover is latched to the baseplate via the latching unit. When a repair or an exchange of the roof antenna is required, the baseplate and the cover can be released from one another in a simple way in that a tool is introduced into the recesses in order to release the engagement between the latching hooks and the latching lugs.

Advantageous embodiments of the invention are described in the description, the drawing as well as in the dependent claims.

In accordance with a first advantageous embodiment the baseplate can be made of metal, wherein the latching hooks are integrally formed in one piece at the baseplate. Hereby, on the one hand, a very stable construction results that, on the other hand, simultaneously forms a screen in the direction of the vehicle interior.

In accordance with a further advantageous embodiment the cover can be made of plastic, wherein the latching lugs are integrally formed in one piece in the interior of the cover. Hereby, an appealing outward appearance results for the entire cover and the baseplate can be arranged in the interior of the cover and/or can be surrounded by this at its outer perimeter. At the same time, the latching unit is hereby accommodated in the interior of the cover in a protected manner.

In accordance with a further advantageous embodiment the latching lugs are formed in such a way that these form an edge at their front end. A tool can be introduced in a particularly favorable manner behind the latching lugs in order to release the engagement with the latching hooks due to such a pointed design of the front end of the latching lugs.

In accordance with a further advantageous embodiment, support ribs can be provided beside the latching lugs in the interior of the cover and in this way bring about a stable support of the baseplate specifically in the region of the latching unit, whereby a particularly secure latching connection is achieved.

In accordance with a further advantageous embodiment the latching lugs can be distributed uniformly over the periphery of the cover in such a way that these can be fixedly connected to the baseplate and/or the vehicle roof over its entire perimeter.

In accordance with a further advantageous embodiment a peripheral seal can be provided between the baseplate and the cover that can be pressed against the vehicle roof in a sealing manner in order to prevent a penetration of humidity into the vehicle interior and into the interior of the roof antenna. Hereby, openings can be provided in the seal that are in particular closed from all sides, and that are, in particular wider than a latching hook. In this way, a tool can be introduced both through the recesses in the baseplate as well as through the openings in the seal in order to release the engagement between the latching lugs and the latching hooks.

In accordance with a further aspect of the invention a tool is provided for releasing the engagement and that is adapted to the latching lugs. For this purpose, the latching lugs have two limbs and a transverse web connecting these and the tool comprises two blades spaced apart at the spacing of the limbs in order to release the limbs of the latching lug from the latching connection if required. The tool can moreover have an abutment between the two blades that abuts at the transverse web on an introduction of the tool.

In accordance with a further aspect of the invention this also relates to a method for mounting a roof antenna of the previously described kind, wherein the cover is placed from above at the opening of a vehicle roof, and the baseplate is placed from below at the opening and the baseplate and the cover are connected to one another with the latching unit in such a way that the vehicle roof is clamped between the cover and the baseplate.

The roof antenna in accordance with the invention can be mounted without tools, whereby a tolerance compensation can be achieved at the same time between the cover and the baseplate by means of the seal. Hereby, a clearance freeness and a rattle freeness is achieved. With regard to recesses provided in the baseplate, moreover a control of the latching hooks can take place in order to ensure that these are latched in accordance with their intended use. Finally, the cover and the baseplate can be exchanged in simple manner and be reused, as a destruction free release of the latching unit is possible by means of a tool.

Figure 2:
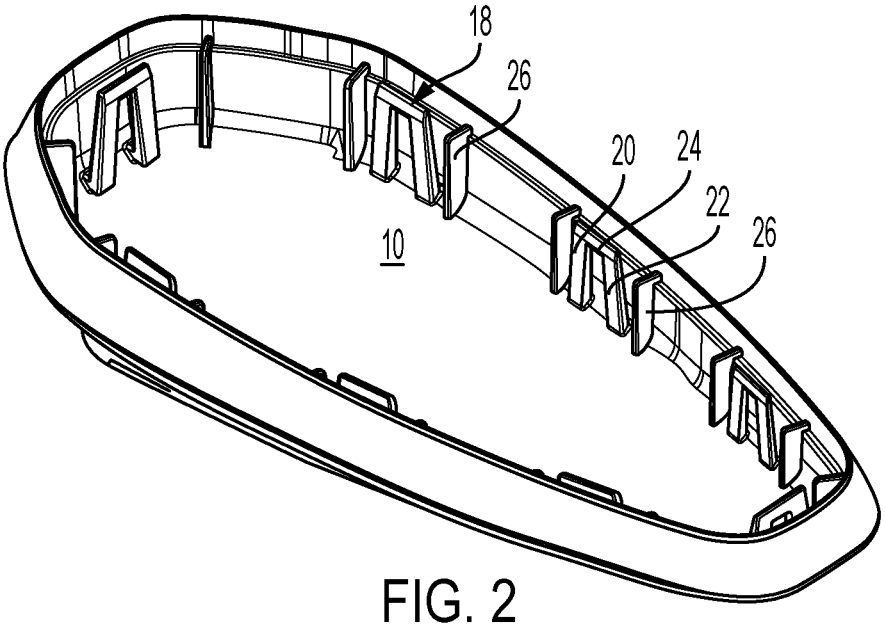
Figure 3:
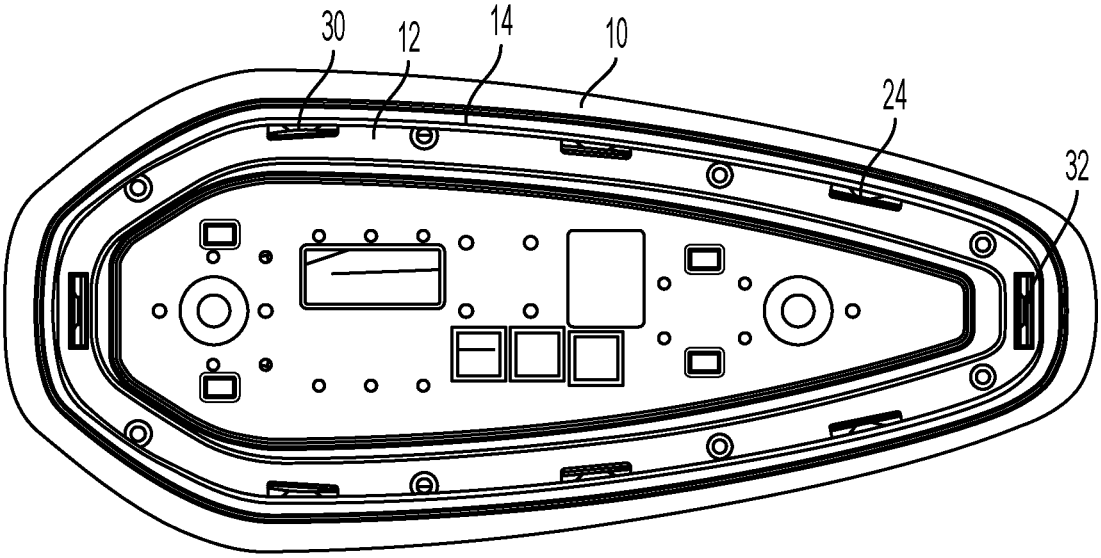
Figure 4:
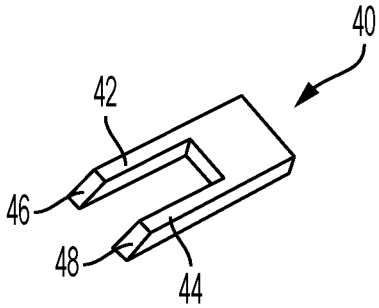

In the following, the present invention will be described purely by way of example by means of advantageous embodiment and with reference to the submitted drawings. There is shown:

FIG. 1 an exploded illustration of a roof antenna;

FIG. 2 a perspective view from below onto the cover of FIG. 1;

FIG. 3 a view from below onto an assembled roof antenna according to FIG. 1; and FIG. 4 a perspective view of a tool.

FIG. 1 shows an exploded illustration of a roof antenna for a vehicle having a cover 10 that can be connected to a baseplate 12 via a latching unit and indeed in such a way that the cover 10 is placed from above and the baseplate 12 is placed from below at an opening of the vehicle roof and these are connected to one another by means of the latching unit in such a way that the vehicle roof is clamped between the cover 10 and the baseplate 12. Hereby, a peripherally extending flexible seal 14 is provided for sealing and for tolerance compensation that is placed onto the baseplate 12 prior to the assembly and that after the assembly is pressed against the underside of the vehicle roof.

The baseplate 12 is made of metal and serves for attachment of diverse electronic components and antennas that are not illustrated in the Figures. In contrast to this, the cover 10 is made of plastic and is constructed at its lower side, such that the outer contour of the cover 10 essentially corresponds to the outer contour of the baseplate 12 (cf. FIG. 3) of this position.

The latching unit for connecting the cover 10 and the baseplate 12, on the one hand, comprises latching hooks 16 that are integrally formed at the baseplate. On the other hand, elastic latching hugs 18 are formed in the interior of the cover along its periphery at essentially uniform spacings that in the assembled state engage behind the latching hooks 16.

Each latching lug 18 has two limbs 20 and 22 that are connected to one another at their outer ends via a transverse web 24. Hereby, the transverse web is formed in a pointed manner in such a way that each latching lug 18 forms an edge at its front end in order to simplify the introduction of a tool for releasing the engagement. As is further emphasized in FIG. 10 a plurality of support ribs 26 are provided in the interior of the cover 10, in particular besides the latching lugs 18 that, on the one hand, stiffen the outer wall of the cover 10, and that, on the other hand, also serve the purpose of forming a rest for the baseplate specifically in the region of the latching connection in order to achieve a stable connection of cover 10 and baseplate 12.

As is shown in FIGS. 1 and 3 recesses 30 and 32 are provided at the baseplate 12 in the region of the latching hooks 16 that enable an engagement of a tool for releasing the engagement between the latching hooks 16 and the latching lugs 18. Hereby, the recesses 30 are provided in the region of the latching hooks 16 at an outer periphery of the baseplate 12 and open towards the outer boundary whereas the recesses 32 are closed from all sides at the front and rear ends of the baseplate 12. All recesses 30 and 32 have a width that corresponds to approximately the distance between the two limbs 20 and 22 and/or the width of a transverse web 24 in such a way that a tool can be introduced through the recesses which tool elastically bends away the limbs 20 and 22 in order to release the engagement between the latching hook 16 and the latching lug 18.

Such that a tool can be introduced through the seal 14 in a non-destructive manner openings 34 closed from all sides are provided in the seal in the region of the latching hooks through which, on the one hand, a respective latching hook 16, and, on the other hand, a tool can extend.

For assembly of the previously described roof antenna at a vehicle roof initially the seal 14 is placed onto the baseplate 12, wherein the latching hooks 16 extend through the openings 34. Subsequently, the cover 10 is placed from above onto an opening of the vehicle roof in such a way that the unit comprising the baseplate 12 and the seal 14 is introduced from below into the cover 10 and in this respect the latching hooks 16 engage the elastic latching hugs 18 from behind (see FIG. 3). Should the roof antenna be released again from the vehicle for repair or exchange, then a tool can be inserted into the recesses 30, 32 of the baseplate 12 as is shown purely by way of example in FIG. 4. The tool 40 is made from a small metal plate that comprises two blades 46 and 48 provided at an end of a web 42 and 44, wherein the two blades 46 and 48 and/or the two webs 42 and 44 are spaced apart from one another at a distance of the limbs 20 and 22 of the latching lugs 18. Hereby, the tool 40 can be introduced from the underside of the baseplate 12 with the blades 46 and 48 between the transverse web 24 and the baseplate 12 in such a way that the latching lugs 18 are bent and the engagement with the latching hook 16 is released. When a tool 40 is correspondingly introduced into all or nearly all recesses 30 and 32 the baseplate can be released from the cover 10 in a nondestructive way. It is naturally understood that also merely a single tool can be provided that simultaneously engages into all or nearly all recesses 30 and 32.

The invention claimed is:

1. A roof antenna for a vehicle, the roof antenna comprising a cover that is connected to a baseplate via a latching unit that comprises latching hooks which engage behind flexible latching lugs, wherein recesses are provided in the baseplate in the region of the latching hooks that enable an engagement of a tool for releasing the latching hooks from engagement with the flexible latching lugs, wherein a peripheral seal is provided between the baseplate and the cover, wherein openings are provided in the peripheral seal that are closed from all sides, wherein the latching hooks extend upwardly from the baseplate through the openings into engagement with the flexible latching lugs, wherein the openings are wider than the latching hooks such that the tool can be introduced through the recesses in the baseplate and through the openings in the peripheral seal in a non-destructive manner to release the latching hooks from the flexible latching lugs.

2. The roof antenna in accordance with claim 1, wherein the baseplate is made of metal and the latching hooks are formed in one piece at the baseplate.

3. The roof antenna in accordance with claim 1, wherein the cover is made of plastic and the latching lugs are integrally formed in one piece in the interior of the cover.

4. The roof antenna in accordance with claim 1, wherein the latching lugs form an edge at their front end.

5. The roof antenna in accordance with claim 1, wherein supporting ribs are provided besides the latching lugs in the interior of the cover.

6. The roof antenna in accordance with claim 1, wherein the latching lugs are arranged uniformly over the perimeter of the cover.

7. The roof antenna in accordance with claim 1, wherein the latching lugs each have a pair of limbs that are connected to one another at outer ends by a transverse web.

8. The roof antenna in accordance with claim 7, wherein the transverse web is formed in a pointed manner in such a way that each latching lug forms an edge at a front end.

9. The roof antenna in accordance with claim 1, wherein the baseplate and the seal are configured to be disposed against an underside of a vehicle roof and the cover is configured to be disposed against a topside of the vehicle roof, such that the vehicle roof is clamped between the cover and the baseplate.

10. The roof antenna in accordance with claim 1, wherein the baseplate and the peripheral seal are connected to one another via the latching hooks extending through the openings in the peripheral seal, wherein the peripheral seal is spaced out of contact from the baseplate.

* * * * *